US006625403B2

(12) United States Patent
Carling et al.

(10) Patent No.: US 6,625,403 B2
(45) Date of Patent: Sep. 23, 2003

(54) PERSONALIZATION OF OPERATOR REPLACEABLE COMPONENT LIFE PREDICTION BASED ON REPLACEABLE COMPONENT LIFE HISTORY

(75) Inventors: Richard Robert Tilney Carling, Lakeville, NY (US); Thomas Leonard Schwartz, Fairport, NY (US); Kenneth Thomas Doty, Rush, NY (US)

(73) Assignee: NexPress Solutions LLC, Rochester, NY (US)

( * ) Notice: Subject to any disclaimer, the term of this patent is extended or adjusted under 35 U.S.C. 154(b) by 0 days.

(21) Appl. No.: 10/008,283

(22) Filed: Nov. 5, 2001

(65) Prior Publication Data

US 2003/0091352 A1 May 15, 2003

(51) Int. Cl.[7] ..... G03G 15/00
(52) U.S. Cl. ..... 399/24
(58) Field of Search ..... 399/24, 25, 26, 399/27, 28

(56) References Cited

U.S. PATENT DOCUMENTS

| | | | | |
|---|---|---|---|---|
| 5,127,012 A | | 6/1992 | Hiliger | 371/29.1 |
| 5,210,571 A | | 5/1993 | Peloquin et al. | 355/203 |
| 5,305,199 A | | 4/1994 | LoBiondo et al. | 364/403 |
| 5,325,156 A | | 6/1994 | Ulinski | 355/209 |
| 5,335,048 A | | 8/1994 | Takano et al. | 355/204 |
| 5,490,089 A | | 2/1996 | Smith et al. | 364/514 R |
| 5,502,543 A | | 3/1996 | Aboujaoude | 355/202 |
| 5,546,163 A | * | 8/1996 | Asai et al. | 399/24 |
| 5,572,292 A | * | 11/1996 | Chatani et al. | 399/25 |
| 5,636,008 A | | 6/1997 | LoBiondo et al. | 399/8 |
| 5,666,585 A | | 9/1997 | Nagira et al. | 399/10 |
| 5,778,279 A | * | 7/1998 | Kawai et al. | 399/42 |
| 5,877,692 A | * | 3/1999 | Watanabe et al. | 399/25 X |
| 5,911,776 A | | 6/1999 | Guck | 709/217 |
| 5,923,834 A | | 7/1999 | Thieret et al. | 395/183.01 |
| 6,012,071 A | | 1/2000 | Krishna et al. | 707/522 |
| 6,154,728 A | | 11/2000 | Sattar et al. | 705/28 |
| 6,188,991 B1 | | 2/2001 | Rosenweig et al. | 705/29 |
| 6,243,548 B1 | | 6/2001 | Hebert et al. | 399/79 |
| 6,263,170 B1 | | 7/2001 | Bortnem | 399/13 |
| 6,295,423 B1 | * | 9/2001 | Haines et al. | 399/24 |

FOREIGN PATENT DOCUMENTS

| | | | |
|---|---|---|---|
| JP | 6-76140 | * | 3/1994 |
| JP | 2000-194586 | * | 7/2000 |

* cited by examiner

*Primary Examiner*—Quana M. Grainger

(57) ABSTRACT

Determining the operational life of Operator Replaceable Component (ORC) devices within a printer. A replacement history of the ORC device is used to predict the future life of a newly installed ORC device. The database management system of the invention provides tracking of the remaining lifetime of the ORC devices. As the system keeps track of the remaining life of the ORC devices, the system will prompt the operator when the ORC devices need to be replaced. Once replaced, the ORC device database is updated with the life span data of the ORC device that was replaced.

20 Claims, 4 Drawing Sheets

PERSONALIZATION OF OPERATOR REPLACEABLE COMPONENT LIFE PREDICTION BASED ON REPLACEABLE COMPONENT LIFE HISTORY

FIELD OF THE INVENTION

The present invention relates to systems that use life histories to determine component life, and more particularly to systems that use heuristics to create a predictor for the expiration of replaceable components.

BACKGROUND OF THE INVENTION

The prior art is replete with complicated systems having numerous parts that wear during normal use. These systems require periodic maintenance to replace worn components. Typically, these complicated systems require service professionals such as field service engineers to repair or replace the components in these systems that wear during periods of normal use. In a number of these complicated systems, the period of time that the system is not working or, working at less than optimum performance, is critical. For many of these systems, it is intended to keep the system running continuously. A digital printing system is one such system. Minimizing down time is critical to the owners and operators of digital printers.

The prior art has recognized that it is important to count the number of uses that are applied to printing devices. One such prior art reference, U. S. Pat. No. 5,383,004 issued to Miller et al. (Miller), discloses a method and apparatus for normalizing the counting of sheets that are printed to compensate for varying sizes of sheets that are printed and provide a more accurate record of the wear on components within the system. However, Miller does not teach a system that will provide the operator with the specific knowledge of the wear on the components within the system, thus enabling the operator to perform maintenance on the system at optimum times. By not providing optimum timing for replacement of components that wear during normal use, the resulting prints are not assured of being of optimum quality. Therefore, the teachings of Miller have a shortcoming in that the operator is not made aware of the current condition of the numerous parts within a printing system that will wear during use.

One solution that has been presented is embodied in U.S. patent application Ser. No. 09/166,326 filed in the name of Burgess (Burgess), commonly assigned with the present invention. Burgess describes a Service Publication System that provides service related information relative to Field Replaceable Units (FRUs). Burgess is useful in providing service related information for field service engineers and the like, by providing service diagnostics and browser enabled publications. However, Burgess relates to a system that is strictly intended to be used by field engineers and field service representatives and does not provide a system that can be readily utilized by the operator. While this system of Burgess is useful in providing data for a field engineer, it does not provide operators with the ability to perform maintenance without the service of a field service representative. Therefore, on-sight maintenance for sophisticated systems is not enabled by the system taught by the Burgess application. Furthermore, Burgess does not perform any type of automated predictor to determine component life. Moreover, it does not teach how to maintain replacement history and calculate a new life expectancy from that replacement history. Therefore, on-sight maintenance and on-sight predicting maintenance lifetimes of components for sophisticated systems is not enabled by the system taught by the Burgess application.

From the foregoing discussion it should be readily apparent that there remains a need within the art for a method and apparatus that provides system operators with the ability to accomplish on-sight maintenance and on-sight predicting of the lifetimes of components within these systems.

SUMMARY OF THE INVENTION

The present invention addresses the shortcomings in the prior art by providing a method and system, wherein the operational life of Operator Replaceable Component (ORC) devices within a printer are determined. The invention involves using replacement history of the ORC devices to predict the future life of respective newly installed ORC devices. The system of the invention provides for the tracking of the remaining lifetime of the ORC devices. As the system keeps track of the remaining life of the ORC devices, the system will prompt the operator when ORC devices need to be replaced. Once replaced, a database for the ORC devices is updated with the life span data of the ORC device that was replaced. The preferred embodiment of the present invention provides tracking usage of the ORC devices in an ORC Tracking Table along with an automated transmission of the ORC Tracking Table to a Graphical User Interface (GUI). Page count, or other additional parameters related to the type of customer usage, is employed to create the ORC Tracking Table chart. The concepts embodied by the present invention enable the operator to know when to perform maintenance on a sophisticated digital press without the requirement of a field service person. Once an operator replaces an ORC device, the life of that ORC device is reset and the entire system will anticipate the next ORC device expiration based on a different expiration parameter.

The present invention provides these and other features by providing an operator-enabled maintenance system having at least one computational element within the system, a history of a plurality of operator replaceable component (ORC) devices within the printer, a life span for each of the ORC devices, the life span being determined by an alterable set of parameters, a use mechanism coupled to each of the computational elements and the ORC devices, the use mechanism tracking use of at least one of the ORC devices using a predetermined parameter, a comparison mechanism that compares the use of the ORC devices to it's expected life span; and a user interface that provides information regarding the remaining amount of the life span for each of the ORC devices.

DETAILED DESCRIPTION OF THE INVENTION

Figure 1:
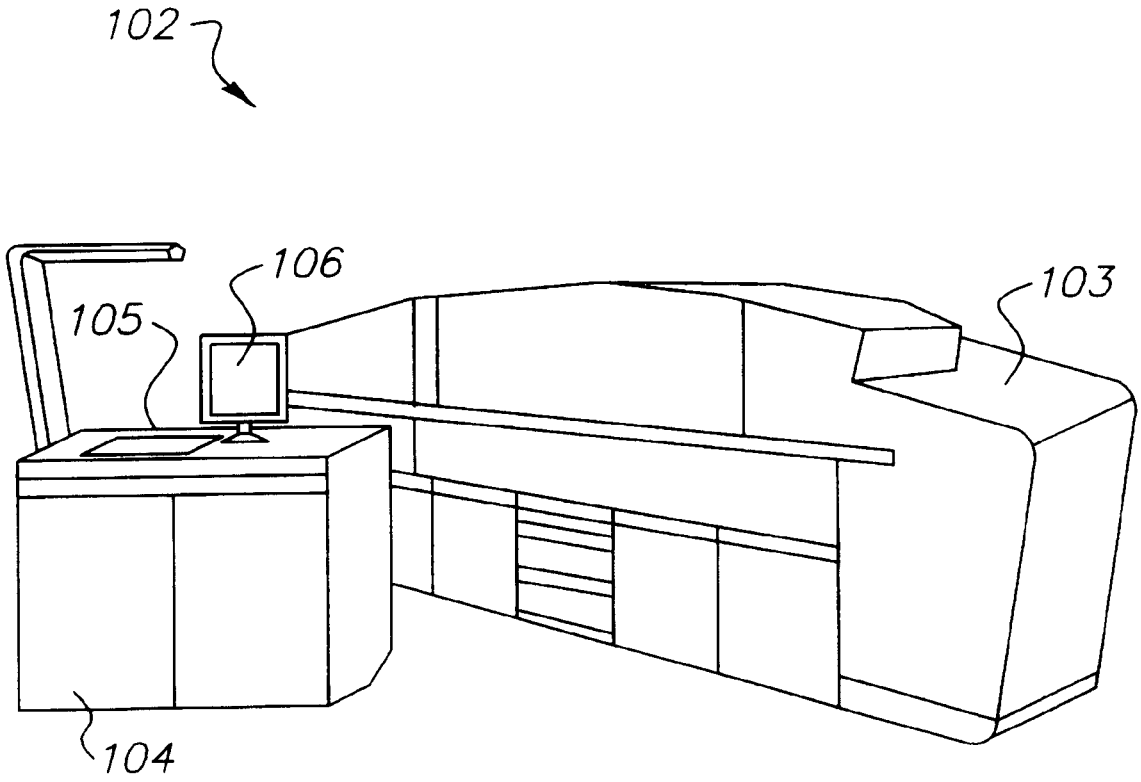
FIG. 1 is a perspective view of a printer apparatus containing the preferred embodiment of the invention.

Referring to FIG. 1, which is an illustration of a printer apparatus 102 for the preferred embodiment of the present invention, a digital printer 103 is provided with Operator Replaceable Component (ORC) devices that enable a typical operator to perform the majority of maintenance on the system without requiring the services of a field engineer. Digital printer 103, in the preferred embodiment, is a NexPress® 2100, however, the present invention pertains to printers in general and digital printing systems in particular. The preferred embodiment as illustrated in FIG. 1 includes, in printer apparatus 102, a user interface 104 which is a NextStation™ adjacent to the NexPress® 2100. The ORC devices are specifically those components used within digital printing apparatus that wear with use. These ORC devices within the preferred embodiment have predictable lifetimes that can be anticipated by parameters relative to the use of the digital printer 103. Therefore, it is possible to anticipate when these ORC devices will need to be replaced before the wear on them results in less than desirable performance in the printer apparatus 102.

The printer apparatus 102 has multiple computational elements, the most notable computational element referred to, herein, as the Digital Front End (DFE). The NexStation™ provides a computational element having a Graphical User Interface (GUI) 106 that interfaces with a database management system within the DFE. It should be understood that while the preferred embodiment details a digital printer 103 having at least one computational element which interfaces and another computational element associated with GUI 106, similar printer apparatus can be provided with more computational elements or fewer computational elements, and that these variations will be obvious to those skilled in the art. In the preferred embodiment, GUI 106 in the NexStation™ provides the operator with the ability to view the current status of ORC devices in the NexPress® 2100 digital printer 103 (in order to perform maintenance in response to maintenance information provided on the GUI 106), as well as any other alerts that are provided from the DFE.

A database management system, contained within the computational elements of the DFE, will receive data for each of the ORC devices that details the usage of each of the ORC devices based, for example, on the number of prints made, the types of paper being used, the color composition of the printed pages. The database management system will also receive inputs from various sensors associated with the digital printer 103. The database management system then takes the received data and creates a life tracking system that keeps track of the remaining life of the ORC devices and informs the operator of the status of the ORC devices via the GUI 106. The preferred embodiment employs tables displayed on the GUI 106 to inform the operators to the current status of the ORC devices. However, it should be noted that numerous variations are possible including, but not limited to, direct messages related to a single ORC device, various types of alarms, or even graphical messages on the GUI 106. The database management system will also prompt the operator when any of the ORC devices need to be replaced. The database management system of the present invention provides tracking of the ORC devices in an ORC Tracking Table along with an automated transmission of the ORC Tracking Table to the GUI 106. The preferred embodiment of the present invention uses page count and parameters related to customer usage, to create the ORC Tracking Table chart. The concepts embodied by the present invention enable the operator to perform maintenance on a sophisticated digital printer. When an operator replaces an ORC, the life counter for that ORC is reset. Table 1 below illustrates a tracking table for ORC devices that would typically be provided on GUI 106 within the preferred embodiment of the invention.

TABLE 1

| Catalog Number | Description | Average Life | Remaining Life | Replaced Qty. | Machine Qty. |
|---|---|---|---|---|---|
| *21004 | NexPress DryInk, Black | 12,500 | 23 | 56 | 1 |
| 21054 | Pressure Roller Cleaner Sheet | 40,000 | 312 | 17 | 1 |
| *21001 | NexPress DryInk, Cyan | 25,000 | 2,852 | 28 | 1 |
| *21002 | NexPress DryInk, Magenta | 25,000 | 3,257 | 28 | 1 |
| *21003 | NexPress DryInk, Yellow | 25,000 | 6,941 | 28 | 1 |
| 21026 | Contact Skive Finger | 45,000 | 8,190 | 120 | 8 |
| | General Press Maintenance | 50,000 | 11,011 | 14 | 1 |
| *21030 | Fuser Fluid | 100,000 | 13,063 | 6 | 1 |
| *21031 | Fuser Cleaning Web | 100,000 | 18,699 | 6 | 1 |
| 21032 | Transport Web | 100,000 | 18,699 | 6 | 1 |
| 21038 | Cleaning Web | 550,000 | 22,578 | 1 | 1 |
| 21063 | Cleaner Sump | 125,000 | 28,814 | 4 | 1 |
| *21051 | DryInk Collection Bottle | 135,000 | 34,125 | 5 | I |
| 21025 | Fuser Roller Ay | 150,000 | 39,002 | 4 | 1 |
| 21059 | Fuser Pads | 475,000 | 40,992 | 1 | 1 |
| 21029 | Donor Roller | 375,000 | 45,671 | 1 | 1 |
| 21061 | Metering Roller | 875,000 | 50,773 | 0 | 1 |
| 21060 | Metering Blade | 475,000 | 52,349 | 1 | 1 |
| | Perfector Belt Maintenance | 200,000 | 55,891 | 3 | 1 |
| 21027 | Pressure Roller | 200,000 | 56,129 | 3 | 1 |
| **21041 | Primary/PreClean Wire | 200,000 | 60,009 | 48 | 16 |
| **21042 | Conditioner/ Tackdown Wire | 200,000 | 61,892 | 33 | 11 |
| **21036 | IC/BC Cleaning Blade | 200,000 | 63,167 | 24 | 8 |
| **21058 | Wiper Pads | 200,000 | 64,287 | 12 | 4 |
| **21044 | Narrow Primary Grid | 7,000,000 | 87,094 | 0 | 4 |
| **21045 | Wide Primary Grid | 3,000,000 | 87,094 | 0 | 8 |
| **21047 | Conditioning Charger Grid | 1,000,000 | 91,075 | 1 | 2 |
| **21050 | PreClean Grid | 2,000,000 | 91,075 | 0 | 4 |
| **21035 | IC/BC Cleaning Brush | 2,200,000 | 105,245 | 0 | 8 |
| **21039 | Imaging Cylinder | 230,000 | 105,245 | 3 | 4 |
| 21017 | Developer, Cyan | 300,000 | 220,145 | 3 | 1 |
| 21018 | Developer, Magenta | 300,000 | 220,145 | 3 | 1 |
| 21019 | Developer, Yellow | 300,000 | 220,145 | 3 | 1 |
| 21020 | Developer, Black | 300,000 | 280,569 | 3 | 1 |
| **21040 | Blanket Cylinder | 330,000 | 301,738 | 3 | 4 |
| 21064 | Water Filter Cartridge | 500,000 | 491,813 | 1 | 1 |
| 21055 | Fuser Lamp | 2,000,000 | 1,000,865 | 0 | 1 |
| **21074 | BC Charger | 1,800,000 | 1,100,865 | 0 | 4 |
| 21057 | Pressure Roller Lamp | 2,000,000 | 1,300,865 | 0 | 1 |
| **21043 | PreClean Charger | 2,000,000 | 1,300,865 | 0 | 4 |
| **21046 | Primary Charger | 2,000,000 | 1,300,865 | 0 | 4 |
| 21048 | Tackdown Charger | 2,000,000 | 1,300,865 | 0 | 1 |
| **21033 | Imaging Cylinder Cleaner | 4,000,000 | 3,300,865 | 0 | 4 |

Table 1 provides a list of ORC devices, with the ORC devices having the shortest remaining life listed first. Each ORC device is given a catalog number to simplify the ordering process and a description to assist the operator with simple recognition of the ORC device. As readily apparent from Table 1, the ORC devices are listed in increasing amounts of remaining life of the ORC devices.

In Table 1, under the column heading Catalog Number, several of the listed have a single asterisk (*) in the first position, before the actual Catalog Number. This asterisk (*) is not actually produced on the GUI 106 but is placed on Table 1 as shown to indicate the items that are not used by the preferred embodiment as ORC devices, but instead have sensors that detect when they must be replenished or replaced. The items in Table 1 having a single asterisk (*) before their Catalog Number generally indicate consumables such as DryInk or fluid. However, there are also items having a single asterisk (*) before their Catalog Number such as the Fuser Cleaning Web or the DryInk collection bottle that are not consumables in the general sense, but use a sensor to detect if the items need to be replaced within the preferred embodiment. Since the indication that the replacement of items with a single asterisk (*) in front of their Catalog Number, is signified by a sensor rather than an expected life span, these items are not ORC devices within the context of the present invention. Therefore, even though the items with a single asterisk (*) before their Catalog Number will have an expected life span listed in the Remaining Life column, their respective object files will have the tracking feature from their expected life span disabled to prevent the tracking of those items with a single asterisk (*) before their Catalog Number. It should be noted that the items with a single asterisk (*) in front of their Catalog Number could be used as ORC devices within the context of the present invention simply by using the value for their expected life span as listed in the Remaining Life column to track the use of these items and indicate when they need to be replaced.

Additional information is provided on GUI 106 as illustrated in Table 1, such as Average Life of that specific type of ORC device, the Replaced Quantity which is the number of times that specific ORC device has been replaced, and Machine Quantity. The Machine Quantity is the physical number of times that a specific ORC exists within the digital printer. The ORC devices that have an entry greater than one within the Machine Quantity column represent ORC devices within the preferred embodiment that would have the tracking feature for their expected life span as listed in the Remaining Life column disabled, such as this feature be disabled within their respective object files. These ORC devices within the Machine Quantity column that have an entry greater than one, are indicated with a double asterisk () before their respective Catalog Numbers in Table 1 and could easily have their remaining life tracked. However, they are not tracked by the preferred embodiment, because they can be interchanged and individual life predictions are difficult. The feature of the preferred embodiment of disabling the expected life tracking feature for those items with a double asterisk () before their respective Catalog Numbers in Table 1 is, therefore, a feature of the preferred embodiment and could easily be altered to have the expected life tracking feature for the items with a double asterisk (**) before their respective Catalog Numbers enabled. Additional use of the columns of information in Table 1 will be discussed further below.

Figure 2:
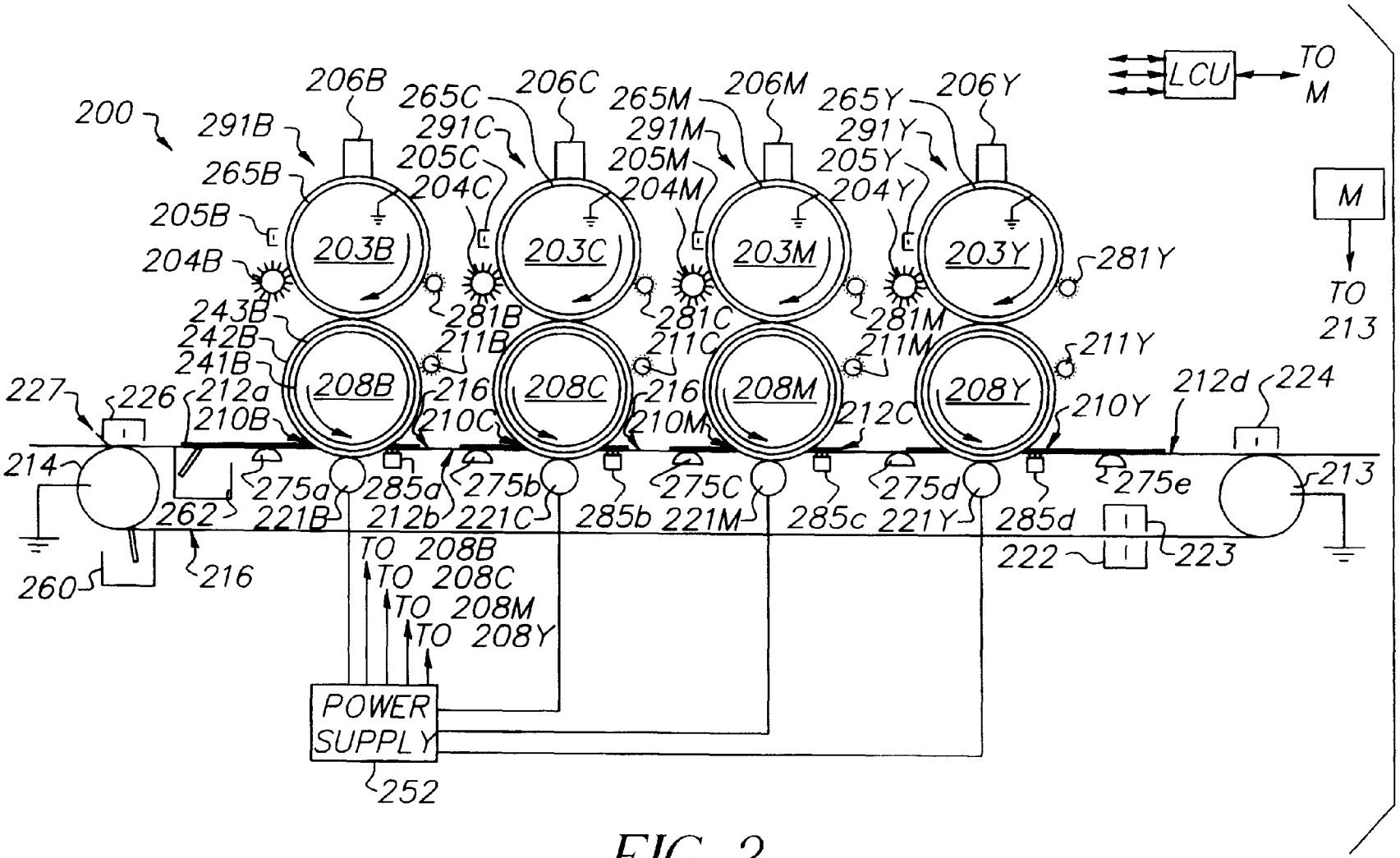
FIG. 2 is an illustration of a printer engine having a plurality of ORCs.

Referring now to FIG. 2 of the accompanying drawings, the details of the printer engine of the digital printer 103 are illustrated, showing the image forming reproduction apparatus, and designated generally by the numeral 200. The reproduction apparatus 200 is an electrophotographic reproduction apparatus and more particularly a color reproduction apparatus wherein color separation images are formed in each of four color modules and transferred in register to a receiver member as a receiver member is moved through the apparatus while supported on a paper transport web (PTW) 216. The reproduction apparatus 200 illustrates the image forming areas for digital printer 103 having four color modules, although the present invention is applicable to printers of all types and more specifically to apparatus having components that wear with use. FIG. 2 illustrates a system having numerous parts that wear with use and must be periodically replaced.

The elements in FIG. 2 that are similar from module to module have similar reference numerals with a suffix of B, C, M and Y referring to the color module for which it is associated; black, cyan, magenta and yellow, respectively. Each module (291B, 291C, 291M, 291Y) is of similar construction. The PTW 216, which may be in the form of an endless belt, operates with all the modules 291B, 291C, 291M, 291Y and the receiver member is transported by the PTW 216 from module to module. Four receiver members, or sheets, 212*a, b, c* and *d* are shown simultaneously receiving images from the different modules, it being understood as noted above that each receiver member may receive one color image from each module and that in this example up to four color images can be received by each receiver member. The movement of the receiver member with the PTW 216 is such that each color image transferred to the receiver member at the transfer nip of each module is a transfer that is registered with the previous color transfer so that a four-color image formed on the receiver member has the colors in registered superposed relationship on the receiver member. The receiver members are then serially detacked from the PTW and sent to a fusing station (not shown) to fuse or fix the dry toner images to the receiver member. The PTW 216 is reconditioned for reuse by providing charge to both surfaces using, for example, opposed corona chargers 222, 223 which neutralize the charge on the two surfaces of the PTW. These chargers 222, 223 are operator replaceable components within the preferred embodiment and have an expected life span after which chargers 222, 223 will require replacement.

Each color module includes a primary image-forming member (PIFM), for example a rotating drum 203B, C, M and Y, respectively. The drums rotate in the directions shown by the arrows and about their respective axes. Each PIFM 203B, C, M and Y has a photoconductive surface, upon which a pigmented marking particle image, or a series of different color marking particle images, is formed. The PIFM 203B, C, M and Y have predictable lifetimes and constitute operator replaceable components. The photoconductive surface for each PIFM 203B, C, M and Y within the preferred embodiment is actually formed on an outer sleeves 265B, C, M and Y, upon which the pigmented marking particle image is formed. These outer sleeves 265B, C, M and Y, have lifetimes that are predictable and therefore, are operator replaceable components. In order to form images, the outer surface of the PIFM is uniformly charged by a primary charger such as a corona charging devices 205B, C, M and Y, respectively or other suitable charger such as roller chargers, brush chargers, etc. The corona charging devices 205B, C, M and Y each have a predictable lifetime and are operator replaceable components. The uniformly charged surface is exposed by suitable exposure means, such as for example a laser, respectively or more preferably an LED array 206B, C, M, and Y, or other electro-optical exposure device or even an optical exposure device to selectively alter the charge on the surface of the outer sleeves 265B, C, M and Y, of the PIFM 203B, C, M and Y to create an electrostatic latent image corresponding to an image to be reproduced. The electrostatic image is developed by application of pigmented charged marking particles to the latent image bearing photoconductive drum by a development station 281B, C, M and Y, respectively. The development station has a particular color of pigmented toner marking particles associated respectively therewith. Thus, each module creates a series of different color marking particle images on the respective photoconductive drum. The development stations 281B, C, M and Y, have predictable lifetimes before they require replacement and are operator replaceable components. In lieu of a photoconductive drum, which is preferred, a photoconductive belt can be used.

Each marking particle image formed on a respective PIFM is transferred electrostatically to an intermediate transfer module (ITM) 208B, C, M and Y, respectively. The ITM 208B, C, M and Y have an expected lifetime and are, therefore, considered to be operator replaceable components. In the preferred embodiment, each ITM 208B, C, M and Y, have an outer sleeve 243B, C, M and Y that contains the surface that the image is transferred to from PIFM 203B, C, M and Y. These outer sleeves 243B, C, M and Y are considered operator replaceable components with predictable lifetimes. The PEFMs 203B, C, M and Y are each caused to rotate about their respective axes by frictional engagement with their respective ITM 208B, C, M and Y. The arrows in the ITMs 208B, C, M and Y indicate the direction of their rotation. After transfer, the toner image is cleaned from the surface of the photoconductive drum by a suitable cleaning device 204B, C, M and Y, respectively to prepare the surface for reuse for forming subsequent toner images. Cleaning devices 204B, C, M and Y are considered operator replaceable components by the present invention.

Marking particle images are respectively formed on the surfaces 242B, C, M and Y for each of the outer sleeve 243B, C, M and Y for ITMs 208B, C, M and Y, and transferred to a toner image receiving surface of a receiver member, which is fed into a nip between the intermediate image transfer member drum and a transfer backing roller (TBR) 221B, C, M and Y, respectively. The TBRs 221B, C, M and Y have predictable lifetimes and are considered to be operator replaceable components by the invention. Each TBR 221B, C, M and Y, is suitably electrically biased by a constant current power supply 252 to induce the charged toner particle image to electrostatically transfer to a receiver sheet. Although a resistive blanket is preferred for TBR 22 1B, C, M and Y, the TBR 221B, C, M and Y can also be formed from a conductive roller made of aluminum or other metal. The receiver member is fed from a suitable receiver member supply (not shown) and is suitably "tacked" to the PTW 216 and moves serially into each of the nips 210B, C, M and Y where it receives the respective marking particle image in a suitable registered relationship to form a composite multicolor image. As is well known, the colored pigments can overlie one another to form areas of colors different from that of the pigments. The receiver member exits the last nip and is transported by a suitable transport mechanism (not shown) to a fuser where the marking particle image is fixed to the receiver member by application of heat and/or pressure and, preferably both. A detack charger 224 may be provided to deposit a neutralizing charge on the receiver member to facilitate separation of the receiver member from the PTW 216. The detack charger 224 is another component that is considered to be operator replaceable within the invention. The receiver member with the fixed marking particle image is then transported to a remote location for operator retrieval. The respective ITMs 208B, C, M and Y are each cleaned by a respective cleaning device 211B, C, M and Y to prepare it for reuse. Cleaning devices 211B, C, M and Y are considered by the invention to be operator replaceable components having lifetimes that can be predicted.

Appropriate sensors (not shown) of any well known type, such as mechanical, electrical, or optical sensors for example, are utilized in the reproduction apparatus 200 to provide control signals for the apparatus. Such sensors are located along the receiver member travel path between the receiver member supply through the various nips to the fuser. Further sensors may be associated with the primary image forming member photoconductive drum, the intermediate image transfer member drum, the transfer backing member, and various image processing stations. As such, the sensors detect the location of a receiver member in its travel path, and the position of the primary image forming member photoconductive drum in relation to the image forming processing stations, and respectively produce appropriate signals indicative thereof. Such signals are fed as input information to a logic and control unit LCU which interfaces with a computational element. Based on such signals and a suitable program for the microprocessor, the control unit LCU produces signals to control the timing operation of the various electrostatographic process stations for carrying out the reproduction process and to control drive by motor M of the various drums and belts. The production of a program for a number of commercially available microprocessors, which are suitable for use with the invention, is a conventional skill well understood in the art. The particular details of any such program would, of course, depend on the architecture of the designated microprocessor.

The receiver members utilized with the reproduction apparatus 200 can vary substantially. For example, they can be thin or thick paper stock (coated or uncoated) or transparency stock. As the thickness and/or resistivity of the receiver member stock varies, the resulting change in impedance affects the electric field used in the nips 210B, C, M, Y to urge transfer of the marking particles to the receiver members. Moreover, a variation in relative humidity will vary the conductivity of a paper receiver member, which also affects the impedance and hence changes the transfer field. Such humidity variations can affect the expected lifetime of operator replaceable components.

In feeding a receiver member onto PTW 216, charge may be provided on the receiver member by charger 226 to electrostatically attract the receiver member and "tack" it to the PTW 216. A blade 227 associated with the charger 226 may be provided to press the receiver member onto the belt and remove any air entrained between the receiver member and the PTW. The PTW 216, the charger 226 and the blade 227 are considered operator replaceable components.

The endless paper transport web (PTW) 216 is entrained about a plurality of support members. For example, as shown in FIG. 2, the plurality of support members are rollers 213, 214 with preferably roller 213 being driven as shown by motor M to drive the PTW. Support structures 275*a, b, c, d* and *e* are provided before entrance and after exit locations of each transfer nip to engage the belt on the backside and alter the straight line path of the belt to provide for wrap of the belt about each respective ITM. This wrap allows for a reduced pre-nip ionization and for a post-nip ionization which is controlled by the post-nip wrap. The nip is where the pressure roller contacts the backside of the belt or where no pressure roller is used, where the electrical field is substantially applied. However, the image transfer region of the nip is a smaller region than the total wrap. Pressure applied by the transfer backing rollers (TBRs) 221B, C, M and Y is upon the backside of the belt 216 and forces the surface of the compliant ITM to conform to the contour of the receiver member during transfer. The TBRs 221B, C, M and Y may be replaced by corona chargers, biased blades or biased brushes, each of which would be considered by the invention to be operator replaceable components. Substantial pressure is provided in the transfer nip to realize the benefits of the compliant intermediate transfer member which are a conformation of the toned image to the receiver member and image content on both a microscopic and macroscopic scale. The pressure may be supplied solely by the transfer biasing mechanism or additional pressure applied by another member such as a roller, shoe, blade or brush, all of which are operator replaceable components as envisioned by the present invention.

Figure 3:
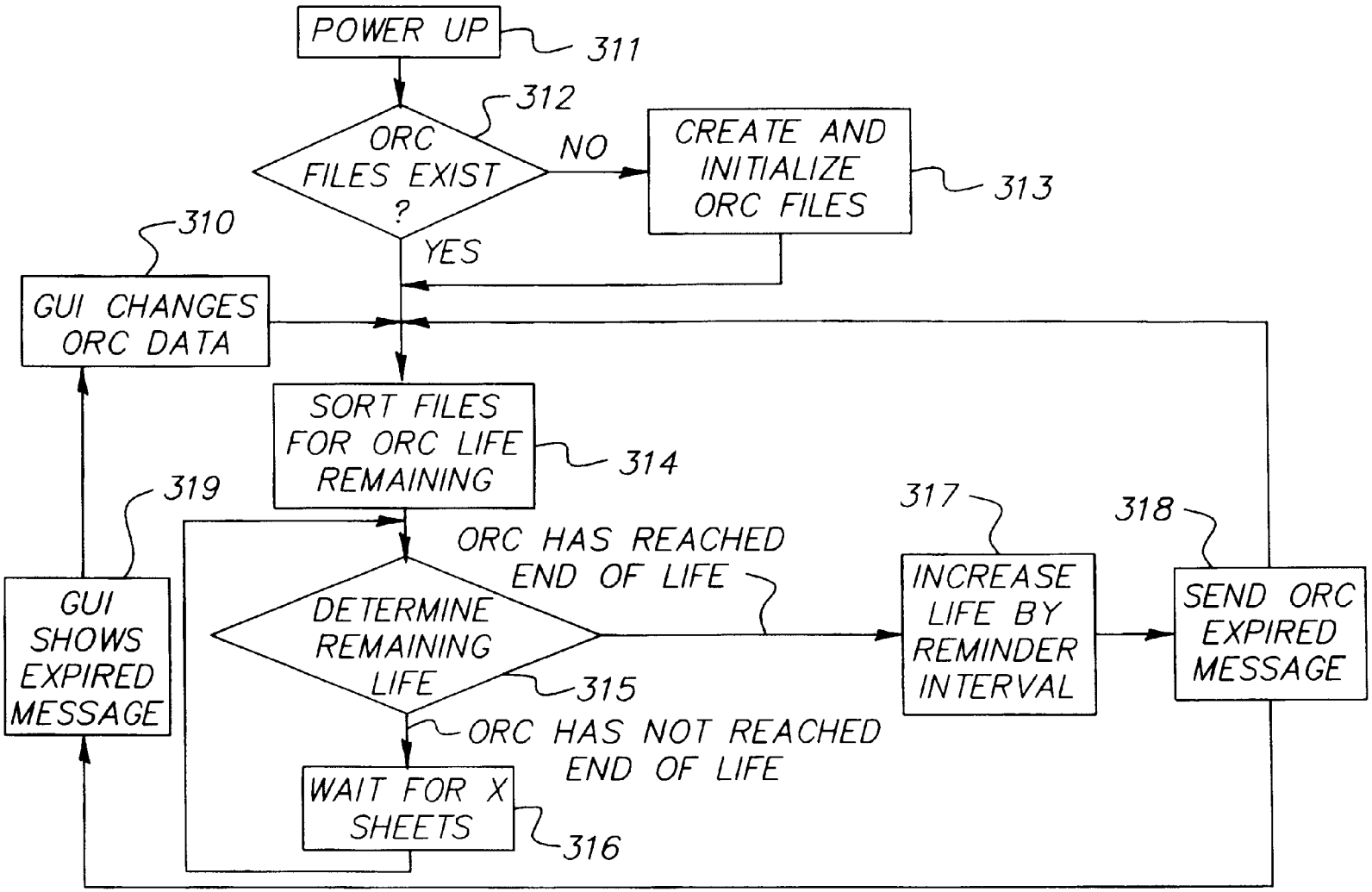
FIGS. 3 and 4 are flowcharts that detail the operations that are performed by the system of the present invention.

FIG. 3 is a flowchart that details the operations that are performed by the database management system of the present invention. ORC Tracking is initialized at Power Up 311 and then begins by executing ORC Files Found 312. ORC Files Found 312 looks at the object files for the ORC devices to check that all necessary object files are present. If any of the necessary object files are not found, then Create and Initialize ORC Files 313 is run to install these files.

The object files within the preferred embodiment are data structures called records. Each record used as an object file contains information related to a particular ORC device. Other types of data structure can also be used to retain the information related to specific ORC devices, however records are the type of data structure used by the preferred embodiment of the invention. Within the preferred embodiment, entries are made within each of the object files for life history of that particular type of ORC device, the predicted life for that specific ORC device that is currently installed and the amount of use on that ORC device that is currently installed. Additionally, each object file can contain a number of setpoints that can be accessed by various computational elements within system 102. The provisions of setpoints that can be accessed by the computational element to the GUI 106, the DFE or any other computational elements in the digital printing system 103 is a feature of the preferred embodiment and it will be readily understood that other architectural configurations can be substituted without departing from the spirit of the present invention. Another item within each of the object files for an ORC device is whether that ORC device is to be dormant. Dormancy as used herein refers to whether a parameter for an ORC device is to be used as a trigger point to alert the operator to a potential problem with that ORC device. The dormancy feature can be either enabled or disabled. The rationale for having a dormancy feature is that with certain types of ORC devices, it might be desirable for the operator to employ visual rather than automatic notification that lifetime of an ORC device has expired. A visual notification would typically be desirable when it is believed that system predictors do not provide sufficient accuracy and that physically looking at the printed output to notice any problems is the best manner by which to determine problems occurring from that ORC. If the dormancy feature for a specific ORC device is disabled, then the trigger mechanism is enabled for that ORC device and will be a potential trigger for an operator alert once the expected lifetime of that ORC device has expired. Another entry that is contained in the object file is for a reminder that is sent to the operator alerting the operator that an ORC device has failed, or will soon fail. As shown in FIG. 3, the Send Reminder Interval 317 alerts the operator when the expected lifetime for an ORC device has expired. The specifics for Send Reminder Interval 317 are acquired by accessing the object file for the particular ORC device in question. The Send Reminder Interval 317 is a message to alert the operator via the GUI 106 and is made by accessing the object file for that specific ORC device and reading entries in the object file. As provided by the preferred embodiment, the reminder interval is a parameter in the object file that is accessed to acquire the reminder period that is used to remind the operator that the specific ORC has an expired expected lifetime. This period can be a time period used to set a timer from which the operator can repetitively be alerted, or it can be measured in terms of use of that ORC device, which in the preferred embodiment would be a number of sheets printed. The time period can also be set in terms of times and dates to alert the operator per minute, per hour, per day or per week. Other information that is contained in the object file for an ORC is information detailing the quantity of that specific ORC device that has been used in the machine over the lifetime of the machine. Additionally, historical data for each one of the ORC devices for that specific ORC device is provided for increased capabilities in the database manager system. In this manner, a computational element can access the object file for a specific ORC device and acquire all the historical data for that ORC device and calculate an expected lifetime for that ORC based on the history of that ORC as it has been used in that digital printing device 103 for that particular user. Historical data can be used to compute expected lifetimes dynamically and provides for a high degree of personalization for a digital printing system. Personalization is important because of the numerous variables that can effect the lifetime of the ORC devices. These variables will be discussed below in more detail.

Still referring to FIG. 3, after the ORC Tracking system verifies that the necessary ORC files exist, the system branches to Sort Files 314, which is a routine that looks at the ORC object files and sorts through them to determine which ORC device should be expected to expire first. The ORC devices within the preferred embodiment have their remaining life determined in terms of the number of remaining A4 pages that can be expected to be printed before failure and this is the type list shown in Table 1. However, it should be noted that Table 1 provides an example list and does not necessarily provide an exhaustive list of every ORC. While the preferred embodiment measures remaining life for ORC devices in terms of pages, it is also within the scope of the invention that remaining life can be measured in time, or by specific date depending on the types of use that a system encounters. The Sort Files 314 routine of the present invention will organize the list of ORC devices in terms of the expected remaining life. The ORC device with the shortest estimated life is listed first, the ORC with the second shortest expected life listed second, and so on until all the ORC devices have been listed in terms of their remaining expected life. In this manner, the preferred embodiment has the earliest expiration period listed first and only needs to look at the first element on the list to provide the operator with information related to the ORC that is expected to expire first. An exception to the foregoing discussion related to the list of ORC devices being where an ORC device has just been replaced or during the first power up of the machine where the Sort Files 314 again must process multiple ORC object files.

The preferred embodiment only requires that the database management system check the object file for that ORC device that is on the top of the list as shown in Table 1 after the Sort Files 314 routine is run and verify that the most recent use of the digital printer 103 has not exceeded the remaining life of that ORC device with the shortest remaining life. The preferred embodiment only needs this single value checked because this is the ORC that is expected to expire first and results in less processing overhead that is placed on system. The Sort Files 314 routine sorts all the ORC devices and sends the list of ORC devices to the GUI 106, which allows the operator to view the life expectancies of the various ORC devices. It should be understood that variations of the above discussed sort routine will be readily apparent to those skilled in the relevant art. There are numerous sort routines known within the art that will provide the necessary functionality required by the present invention.

Determine Remaining Life 315 takes the remaining life values from the object file for each of the ORC devices and decrements the remaining life value for each of the ORC devices by the number of pages that have been printed since the last time Determine Remaining Life 315 has been run. A determination is made if any of the ORC devices lifetime has expired. In the preferred embodiment, a printed sheet would typically be an A4 page and a sheet that is 11 inches by 17 inches would result in decrementing the remaining life of the ORC device by two pages. Therefore, the remaining life values in the object files for each of the ORC devices are decremented by 1 for each A4 sheet that is printed and by 2 for each 11 inch by 17 inch sheet that is printed. Duplex pages would typically be counted twice as much as a single sided page in determining the remaining life of the ORC devices. The parameters used to determine the remaining life of the ORC devices can also be related to color. Sheets that require substantial amounts of color or large amounts of particular colors can have individual parameters indicative of the usage of large amounts of that color or colors.

If the result of Determine Remaining Life 315 indicates that an ORC has Reached the End of its Lifetime, then Send Reminder Interval 317 accesses the object file for that object file as previously discussed and sets up the interval with which the operator will be reminded that the expected life span for that ORC has expired. Once Determine Remaining Life 315 makes a determination that one of the ORC devices has reached its expected lifetime, the preferred embodiment has Send ORC Expired Message 318 to provide the operator with a notification of the fact that an ORC has expired by alerting the operator via GUI 106. It will be readily understood to those skilled in the art, that there are numerous means for notification. The alert can be by any alarm mechanism. The alert can also be via a user interface that is not a graphical user interface.

If Determine Remaining Life 315 indicates that none of the ORC devices have reached their expected lifetime, Wait for Time Period 316 provides a function that will allow a predetermined parameter to expire before branching back to Determining Remaining Life 315. In the preferred embodiment Wait for Time Period 316 will provide a timer that is set to wait a predetermined period of time before branching back to Determine Remaining Life 315. The time period set by Wait for Time Period 316 in the preferred embodiment is set to match the remaining life of the ORC device with the lowest expected lifetime. Other parameters can be used instead of time periods to determine the actual period of Wait for Time Period 316, and the use of other parameters is specifically envisioned by the present invention. Among these different parameters are time periods other than the remaining life of an ORC device, such as a specific number of sheets that have been printed (or possibly every sheet) instead of, or in combination with time periods related to the remaining life of an ORC. Additionally, specific time periods can be used to establish the time period used by Wait for Time Period 316.

After the parameter used by Wait for Time Period 316 has expired, Determine Remaining Life 315 will again access the remaining life values from the object files for the ORC devices and decrement the remaining life value for each of the ORC devices by the number of pages that have been printed since the last time Determine Remaining Life 315 has been run, as previously stated.

The NexPress® 2100 uses the concept of Operator Replaceable Component (ORC) devices to reduce overall per page print cost and maximize print quality and uptime at the customer site. The ORC devices within the preferred embodiment of the present invention, are components within the printer that are designed to be replaced by the printer operator without requiring the services of a more highly skilled field engineer. In order for ORC devices to achieve the goal of reducing per page print costs, it is necessary to know when the "optimal" life of an ORC device has been reached. Here "optimal" is used to describe the point after which further printer use with the ORC device that has reached its' optimal life will potentially either adversely affect print quality or fail. It is important in any printing system to understand the variables that result in print quality. It is extremely important in systems involving high-end digital printers, that the variables affecting print quality are well known. Additionally, the operators for these printing systems need to be aware of the state of the variables that can affect print quality. The present invention addresses these needs by providing a realtime update of the expected life span for ORC devices upon demand as well as notification of a situation where the expected lifespan of an ORC device is about to expire, or in fact already has expired. The specific timing of this notification also needs to be as accurate as possible, especially in high-end digital printing systems, because of the high volume of prints that are made to insure maximum component life is not exceeded, which in turn results in minimizing the per page print cost for that printer and maximizing print quality.

Actual life of a specific ORC in a specific printer is dependent on many factors. Among these factors are the number of pages printed, the size of the pages, printing on one side (simplex) versus both sides (duplex) of the paper, the type of finish, the characteristics of the paper, the environment in which the printer resides (room temperature, air quality, dust contaminants), the number of times the printer is shut down and restarted, and the manufacturing quality of the ORC. While it is not practical for the system to immediately characterize all of the variables that affect the life of an ORC device, it is possible to provide systems that can characterize these variables that have a determining factor in the life of a specific ORC. The present invention envisions predicting the lifetimes of ORC devices accurately by taking into account the past history of the same or similar ORC devices.

To achieve the goal of predicting the life of an ORC device as accurately as possible, the present invention envisions provides ORC tracking system software that can perform these important tasks. Once a specific ORC device has expired, a replacement for that specific ORC device is placed into the system. The system software then takes the life information for the expired ORC device and places it into a history list file for that ORC device. In the preferred embodiment this history file would be retained in the object file as previously discussed. When that specific ORC device is replaced again, the additional history information is added to this list so that life history for each specific ORC device can be retrieved and used for calculation. After an ORC device is replaced, the system software calculates a new life expectancy based on the life spans of the previous ORC devices. The new life expectancy then becomes the expected life span for the ORC device.

For an unweighted average of N histories for a specific ORC, this would be calculated using the formulas shown in Equations 1*a* and 1*b* to arrive at the total history and the new life calculations, which are a generalization of unweighted Average Calculation for N ORCs.

$$\text{Total_History}=\text{history}_N+\text{history}_{N-1}+\text{history}_{N-2}+\text{history}_{N-3}\ldots\text{history}_1 \quad \text{Equation 1}a$$

$$\text{new_life}=\text{Total_History}/N \quad \text{Equation 1}b$$

In the preferred embodiment, the ORC device tracking system typically employs default values for life expectancy of the ORC devices. The historical data derived from previously used ORC devices is employed, by the preferred embodiment, after there have been sufficient numbers of ORC devices of a specific type replaced. The object files for each of the ORC devices keeps a record of the number of times a specific ORC device has been replaced, as well as the average life of an ORC device. Using a replacement history for a specific ORC device that equals 10 replacements, Equations 2*a* and 2*b* illustrate the total history and the new life calculations. Calculation of unweighted Average of 10 ORCs $$\text{Total_History}=\text{history}_{10}+\text{history}_9+\text{history}_8+\text{history}_7+\text{history}_6+\text{history}_5+\text{history}_4+\text{history}_3+\text{history}_2+\text{history}_1 \quad \text{Equation 2}a$$

$$\text{new_life}=\text{Total_History}/10 \quad \text{Equation 2}b$$

A number of variations for calculating the predicted life have been used, including weighted averages and averages that take into account fewer replacement histories. The present invention uses historical data to predict component replacement by employing a relatively simple mathematical formula.

By calculating a new life based on replacement history, the system software can adapt to changes in variables that effect print quality such as printer usage and printer environment. The system software can then reflect the impact of these variable changes in the predicted life of the ORCs. Once in place with the ability to adapt the predicted life of the ORCs to variable changes, the system software can personalize the predicted ORC life on a per printer basis dynamically as ORCs are replaced and account for all the factors that influence an ORCs life by using historical ORC life data. By accounting for the variable influences on ORC life, the system achieves the goal of optimizing predicted ORC component life on a per printer basis, minimizing per page print costs while maximizing print quality.

A further embodiment of the present invention is to use a weighted average incorporating a predefined "default life" for initial part replacement until a suitable number of replacements histories have been made to provide an "interim" accurate average. As an example, take 10 histories as a sample of the preferred number of histories to use to determine future life, if there is less than 10 histories, a weighted average based on the number of histories available (up to 10) divided by 10 (which gives us a number between 0.0 and 1.0, where we get 1.0 if we have at least 10 histories and we get 0.0 if we have no replacement histories) multiplied by the average of the histories and the inverse of this number multiplied by the "default life" and the two numbers then added together to give us a predicted life. The Calculation of weighted Average of less than 10 ORCs and a "Default Life" is shown by Equations 3*a*, 3*b* and 3*c*.

$$\text{Ratio}=\text{Total History (up to 10) divided by 10.0} \quad \text{Equation 3}a$$

$$\text{InverseRatio}=1.0-\text{Ratio} \quad \text{Equation 3}b$$

$$\text{Predicted_Life}=\text{new_life (from Equation 2)}*\text{Ratio}+\text{default_life}*\text{InverseRatio} \quad \text{Equation 3}c$$

It should also be noted, that the Predicted Life can be determined without using any default value. One such manner of doing this would be to allow the first ORC device to expire, and then use the life of that first ORC device as the replacement history. Once the replacement history is initiated, the operator could use the replacement history as the expected life of the ORC device. The replacement history could then be updated as future ORC devices are used. It should be readily understood that there are numerous weighted averages that can be employed to determine a predicted life of an ORC device.

Figure 4:
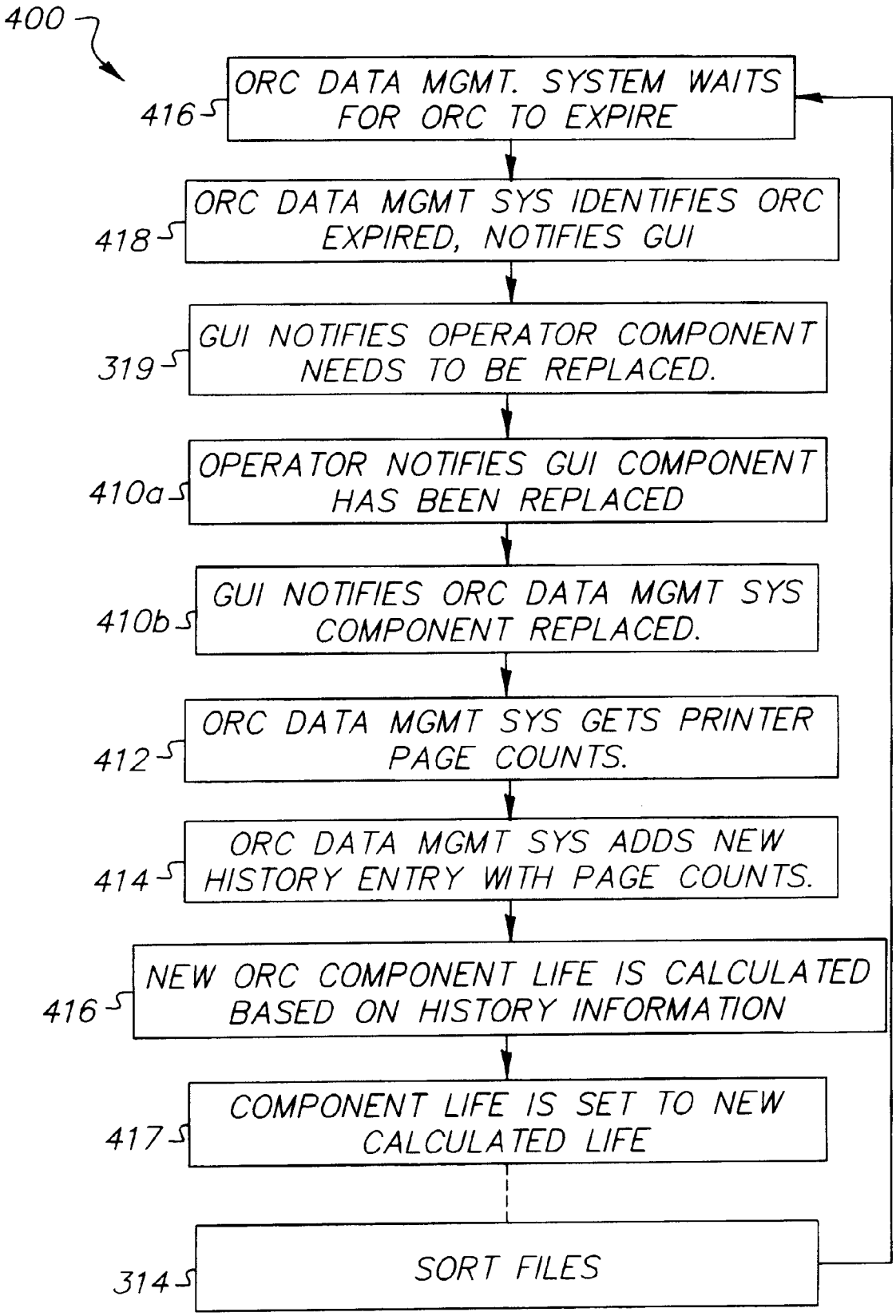

FIG. 4 is a flowchart showing the operation of the present invention employing the ORC Tracking previously described used in combination with history data used to predict life span for the ORCs. Generally referred to as 400, the series of events for determining the predicted life span using ORC history data is a combination of what has previously been discussed for the flowchart shown in FIG. 3 together with the portion that employs ORC data to generate ORC device life expectancy. The series of events from FIG. 3 are present in FIG. 4 in a more high level form for the sake of brevity. Wait for ORC to Expire 416 is essentially equivalent to the series of steps from the flowchart in FIG. 3 Determine Remaining Life 315 and Wait for Time Period 316. Once an ORC expires (as previously discussed) the system will then perform Identify the ORC Expired and Notify GUI 418, which is similar to the combination of Send ORC Reminder Interval 317 and Expired Message 318 of FIG. 3. Identify the ORC Expired and Notify GUI 418 will alert the print operator that the expected lifetime of an ORC has expired and that the ORC needs to be replaced. Notify GUI of ORC Replacement 410*a* is where the operator inputs to the user interface (the GUI 106) that the expired ORC has been replaced and GUI Notifies ORC Data management of ORC Replacement 410*b* informs the ORC database manager that a new ORC has been installed in place of the ORC that has expired. Update ORC Data Management System With Printer Page Counts 412 updates the ORC database manager with any page counts from recent use of the digital printer 103 that have not yet been accounted for by the system 102. ORC Data Management System Adds New History Data With Page Count Updates 414 takes the page counts from Update ORC Data Management System With Printer Page Counts 412 and updates the ORC database manager. New ORC Component Life is Calculated 416 takes the updated ORC database manager information and computes a new life expectancy for the ORC that has just been replaced using the equations that have previously been discussed. Component Life is Set 417 takes the computed life and applies it to the ORC that has just been replaced. The system of the preferred embodiment then braches back Waits for ORC to Expire 416 because the preferred embodiment of the present invention has different computational elements performing the flowcharts shown in FIG. 3 and FIG. 4. The flowchart in FIG. 4 is performed by the computational elements in the NexStation™ and the Sort Files 314 routine of FIG. 3 is performed by the DFE for the digital printer 103.

In systems having only one computational element, or using only one computational element to perform both the flow charts shown in FIG. 3 and FIG. 4, then Sort Files 314 would be run after Components Life is Set 417 as shown by the dotted line in FIG. 4. Here, the object files for the ORC devices would again be looked at to determine which ORC has the shortest life expectancy. As previously detailed in the discussion related to FIG. 3, there are numerous ways that the ORC object files can be sorted, and also numerous ways by which time periods can be set. It will be readily apparent to those skilled in the art, that there are alternatives to using the ORC with the shortest life as the basic parameter by which to operate from. Numerous thresholds can be applied. Multiple thresholds can operate simultaneously for different ORC devices to alert the operator when life expectancies are running short.

The foregoing discussion has described the preferred embodiment of the present invention, variations will be readily apparent to those of ordinary skill in the art, therefore, the scope of the invention should be measured by the appended claims.

What is claimed is:

1. A system with operator enabled maintenance for a plurality of operator replaceable component (ORC) devices within a reproduction device, said system comprising:

at least one computational element within said system;

a life span for each of said ORC devices, said life span being determined by an alterable set of parameters, including a replacement history generated using a formula generated from heuristics on said operator replaceable components having at least one threshold for each of the ORC devices;

a use mechanism coupled to each of said computational elements and said ORC devices, said use mechanism tracking use of at least one of said ORC devices using a predetermined parameter;

a comparison mechanism that compares use of said ORC devices to said life span; and a user interface, associated with said at least one computational element, that provides information regarding remaining amount of said life span for each of said ORC devices.

2. The system of claim 1, wherein said reproduction device is a digital printer.

3. The system of claim 2, wherein said use mechanism uses as said predetermined parameter a categorization based on type of pages printed.

4. The system of claim 2, wherein said categorization further comprises data based on type color printed.

5. The system of claim 2, wherein said categorization further comprises data based on density of images on pages printed.

6. The system of claim 1, wherein said alterable set of parameters further comprises a replacement history generated from said operator replaceable components previously used.

7. The system of claim 1, wherein said replacement history is used to determine an expected life span of a current part, said expected life span being used as said life span.

8. The system of claim 1, wherein said default value for said alterable set of parameters is generated using a default life span, and is substituted with a weighted average of histories for said operator replaceable components after a predetermined number of said operator replaceable components have been replaced.

9. The system of claim 1, further comprising an operator notification system, associated with said user interface, coupled to the computational element that is activated when a predetermined threshold is reached.

10. The system of claim 1, wherein the user interface provides operator notification when said life span has expired.

11. The system of claim 10, wherein the user interface is a graphical user interface.

12. The system of claim 2, wherein said use mechanism uses as said predetermined parameter a number of pages printed.

13. A method for enabling operator maintenance on a reproduction device having a plurality of operator replaceable component (ORC) devices, and at least one computational element that is operatively coupled to said plurality of ORC devices, comprising the steps of:

determining a life span for each of said ORC devices in accordance with an alterable set of parameters, using a formula generated from heuristics on said operator replaceable components to determine said alterable set of parameters;

making a use record of said system;

comparing said use record to at least one of said life spans to determine if at least one of said life spans exceeds said use record by a predetermined amount;

responding to the comparing step when the at least one of said life spans does not exceed said use record by said predetermined amount to make a determination that at least one of said ORC devices needs replacement; and replacing the at least one of said ORC devices and updating said life span for the at least one of said ORC devices.

14. The method of claim 13, wherein the step of determining said life span further comprises using a replacement history generated from said operator replaceable components previously used to determine said alterable set of parameters.

15. The method of claim 13, wherein the step of determining said life span with said alterable set of parameters being generated from a default life span.

16. The method of claim 15, wherein the step of determining said life span substitutes as said default values a weighted average of histories for said operator replaceable components after a predetermined number of said operator replaceable components have been replaced.

17. The method of claim 13, wherein the step of determining said life span further comprises determining an expected life span of a current part and using said expected life span as said life span.

18. The method of claim 13, wherein the step of determining said life span further comprises determining said life span in accordance with a set of alterable parameters that includes at least one threshold for each of said ORC devices.

19. The method of claim 18, wherein the step of responding to the comparing step further comprises notifying the operator when said threshold is reached.

20. The method of claim 19, wherein the step of determining said life span further comprises a number of pages printed as said threshold.

* * * * *